US011013346B2

(12) United States Patent
Redford

(10) Patent No.: US 11,013,346 B2
(45) Date of Patent: May 25, 2021

(54) NURSING PILLOW AND METHODS FOR EFFICIENT DISPLAY OF NURSING PILLOWS

(71) Applicant: Walmart Apollo, LLC, Bentonville, AR (US)

(72) Inventor: Sarah Redford, Bella Vista, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 245 days.

(21) Appl. No.: 15/881,822

(22) Filed: Jan. 29, 2018

(65) Prior Publication Data

US 2018/0242755 A1 Aug. 30, 2018

Related U.S. Application Data

(60) Provisional application No. 62/464,121, filed on Feb. 27, 2017.

(51) Int. Cl.
*A47D 13/08* (2006.01)
*B65D 81/20* (2006.01)
*G06Q 99/00* (2006.01)

(52) U.S. Cl.
CPC ..... *A47D 13/083* (2013.01); *B65D 81/2007* (2013.01); *G06Q 99/00* (2013.01)

(58) Field of Classification Search
None
See application file for complete search history.

(56) References Cited

U.S. PATENT DOCUMENTS

| | | | | |
|---|---|---|---|---|
| 4,054,204 | A | 10/1977 | Keeton | |
| 5,790,999 | A | 8/1998 | Clark | |
| 6,119,873 | A * | 9/2000 | Matthews | A47F 7/0007 211/196 |
| 6,564,408 | B2 * | 5/2003 | Van Vuuren | A47D 5/00 5/632 |
| 8,695,137 | B1 | 4/2014 | Hanson | |
| 9,138,072 | B1 * | 9/2015 | Sanders | A47D 13/083 |
| 9,254,031 | B1 | 2/2016 | Zenoff | |
| 2002/0023301 | A1 * | 2/2002 | Vuuren | A47D 13/083 5/655 |
| 2008/0011747 | A1 * | 1/2008 | Anderson | B65D 29/00 220/9.4 |
| 2008/0098533 | A1 * | 5/2008 | Erdman | A47C 27/001 5/722 |
| 2013/0145556 | A1 * | 6/2013 | Kummerfeld | A47D 13/00 5/655 |
| 2014/0359947 | A1 * | 12/2014 | Turner | A47D 13/083 5/655 |

(Continued)

OTHER PUBLICATIONS

"Natural curve nursing pillow + heathered grey cover with handle," ErgoBaby.eu, accessed Feb. 7, 2017.

(Continued)

*Primary Examiner* — David R Hare
*Assistant Examiner* — Adam C Ortiz

(57) ABSTRACT

A nursing pillow is provided, having a continuous body structure, a receiving area configured to receive a torso of a user, and a nursing surface configured to accommodate an infant in an inclined position on the nursing pillow. A method for displaying a plurality of nursing pillows on a salesfloor, is also provided.

18 Claims, 6 Drawing Sheets

(56) References Cited

U.S. PATENT DOCUMENTS

2016/0066707 A1* 3/2016 Telford ..... A47D 13/08
5/655

OTHER PUBLICATIONS

"White nursing pillow," AdenandAnais.com, accessed Feb. 7, 2017.
"Fisher Price Perfect Position 4N1 Nursing Pillow Newborn Mother Mobile Nursery," Ebay.com, accessed Feb. 7, 2017.
"My Brest Friend Twins Plus Deluxe Nursing Pillow, Grey," Ebay.com, accessed Feb. 7, 2017.
Norayoung, "Target: Boppy Bare Naked Nursing Pillow only $13.99 After Coupon and Gift Card (reg. $34.99)," CouponingWithRachel.com, Apr. 5, 2013.
"Buy Your New Mattress at Costco!" (the Costco Connoisseur) [online] (retrieved from the Internet on Apr. 16, 2018) <URL https://costcoconnoisseur.blogspot.com/2014/08/new-mattress.html> Aug. 26, 2018.
International Search Report and Written Opinion for PCT Application No. PCT/US18/15679, dated May 25, 2018.
International Preliminary Report on Patentability for PCT Application No. PCT/US18/15679, dated Sep. 6, 2019. 9 pages.

* cited by examiner

NURSING PILLOW AND METHODS FOR EFFICIENT DISPLAY OF NURSING PILLOWS

CROSS REFERENCE TO RELATED APPLICATION[S]

This application claims the benefit of U.S. Provisional application No. 62/464,121, filed Feb. 27, 2017, the contents of which are incorporated herein in their entirety.

FIELD OF TECHNOLOGY

The following relates to a nursing pillow and method for displaying nursing pillows more specifically to embodiments of a nursing pillow that promotes a proper infant swallowing position, which can be effectively displayed on a shelf on a salesfloor.

BACKGROUND

Nursing pillows are cushioned devices worn by caretakers when feeding or nursing an infant. Current nursing pillow designs result in the infant being positioned improperly for swallowing. In particular, the current nursing pillows hamper the swallowing of the infant when feeding, as well as increase an air intake into the infant's stomach, which can be a source or cause for gas and colic. Often times, the caretaker must shift the nursing pillow during feeding from side-to-side, which can disrupt the infant's feeding position. Moreover, the bulky nature of the nursing pillow prohibits proper and efficient shelf-utilization on a salesfloor, which limits the number of nursing pillows that may stocked for customers.

Thus, a need exists for a nursing pillow that promotes a proper infant swallowing position, which can be effectively displayed on a shelf on a salesfloor.

SUMMARY

A first aspect relates generally to a nursing pillow comprising: a continuous body structure, the continuous body structure including a first portion extending from a middle portion to a first free end, a second portion extending from the middle portion to a second free end, the first free end spaced apart from the second free end by an opening therebetween, a receiving area located between the first portion and the second portion, the receiving area configured to receive a torso of a user, such that the first portion wraps partially around a first side of the torso of the user, the second portion wraps partially around a second side of the torso of the user, and the middle section faces a front side of the torso of the user, and a nursing surface defined by a top surface of the continuous body structure, the nursing surface configured to accommodate an infant, wherein a thickness of the continuous body structure at the first free end and the second free end is greater than a thickness of the continuous body structure proximate the middle portion.

A second aspect relates generally to a nursing pillow comprising: a continuous body structure, the continuous body structure including a first portion extending from a middle portion to a first free end, a second portion extending from the middle portion to a second free end, the first free end spaced apart from the second free end by an opening therebetween, and a receiving area located between the first portion and the second portion, the receiving area configured to receive a torso of a user, such that the first portion wraps partially around a first side of the torso of the user, the second portion wraps partially around a second side of the torso of the user, and the middle section faces a front side of the torso of the user, wherein the continuous body structure has a gradually reducing thickness in a direction away from the torso of the user, such that an infant, when residing on the nursing surface, is prevented from being wedged in a gap between the continuous body structure and the torso of the user.

A third aspect relates generally to a method of displaying a plurality of nursing pillows on a salesfloor, the method comprising: reducing a size of the plurality of nursing pillows by vacuum sealing each nursing pillow of the plurality of nursing pillows inside a stackable vacuum unit, wherein each nursing pillow includes a ramped nursing surface, and stacking the stackable vacuum unit on a shelf located on the salesfloor to reduce a volume per nursing pillow on the shelf.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
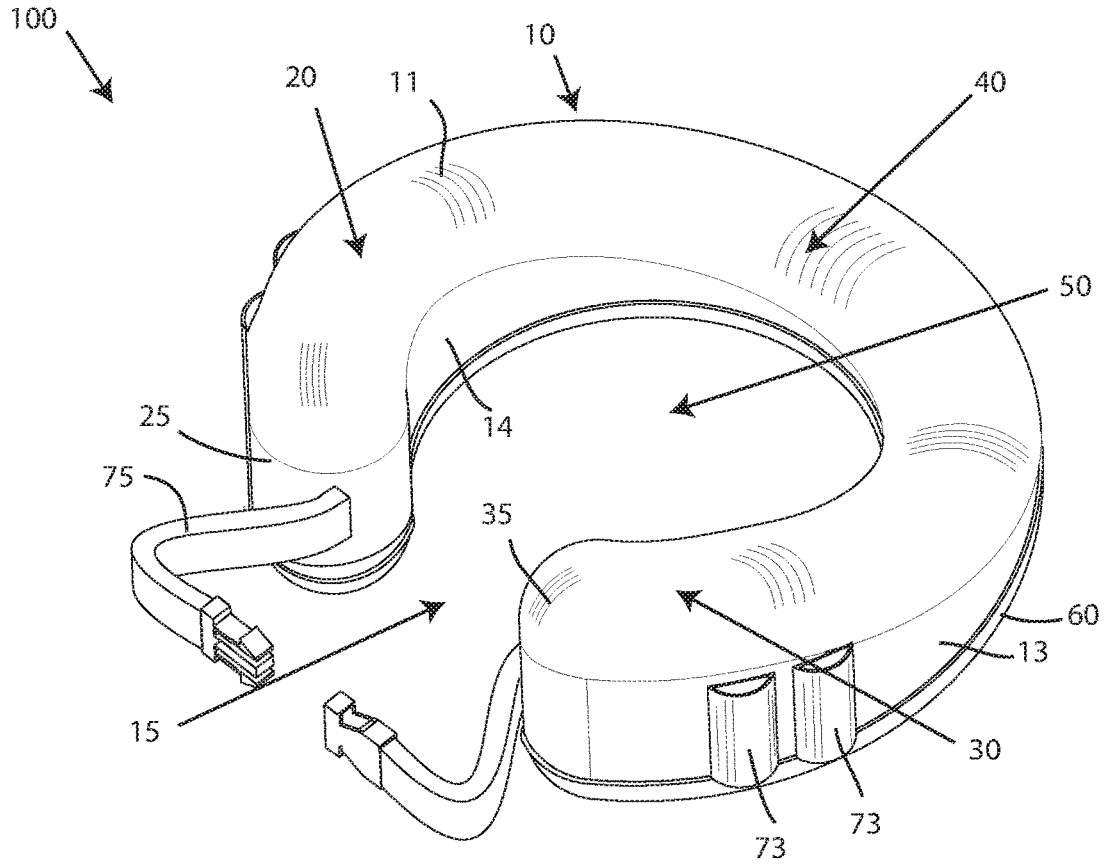
FIG. 1 depicts a rear, perspective view of an embodiment of a nursing pillow.
Figure 2:
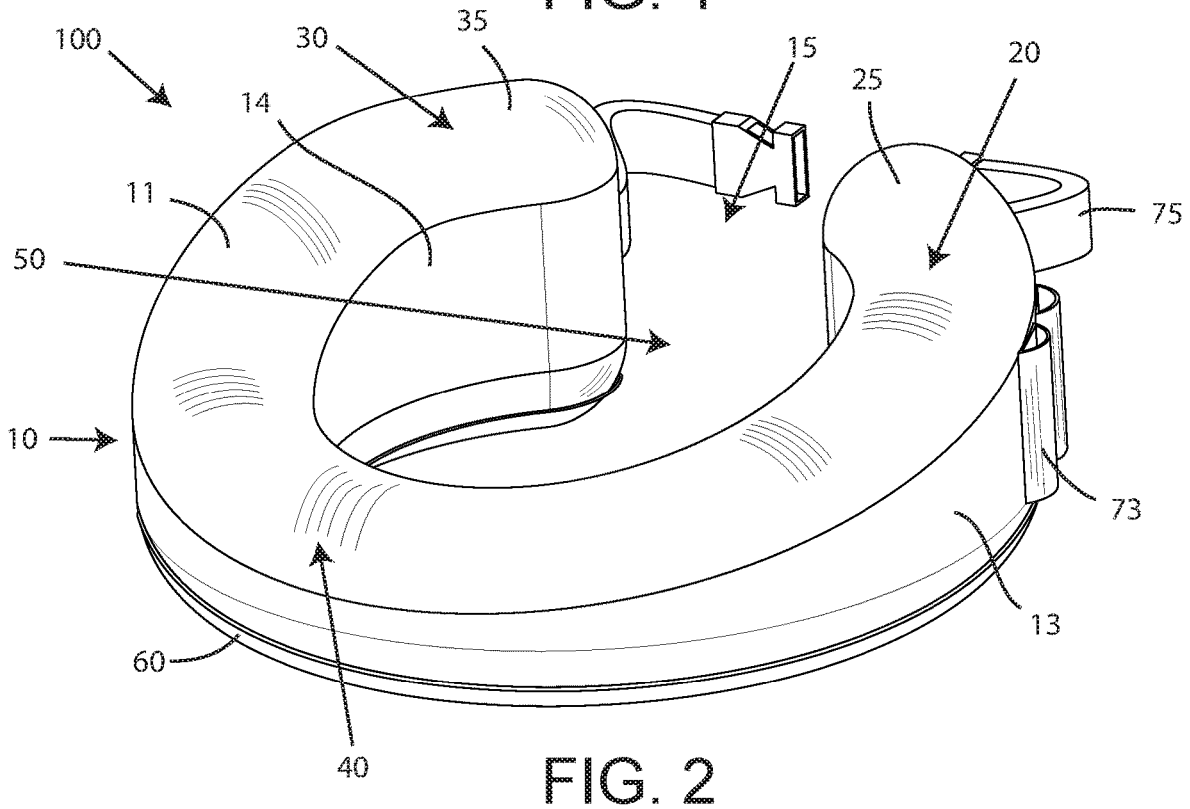
FIG. 2 depicts a front, perspective view of an embodiment of the nursing pillow.
Figure 3:
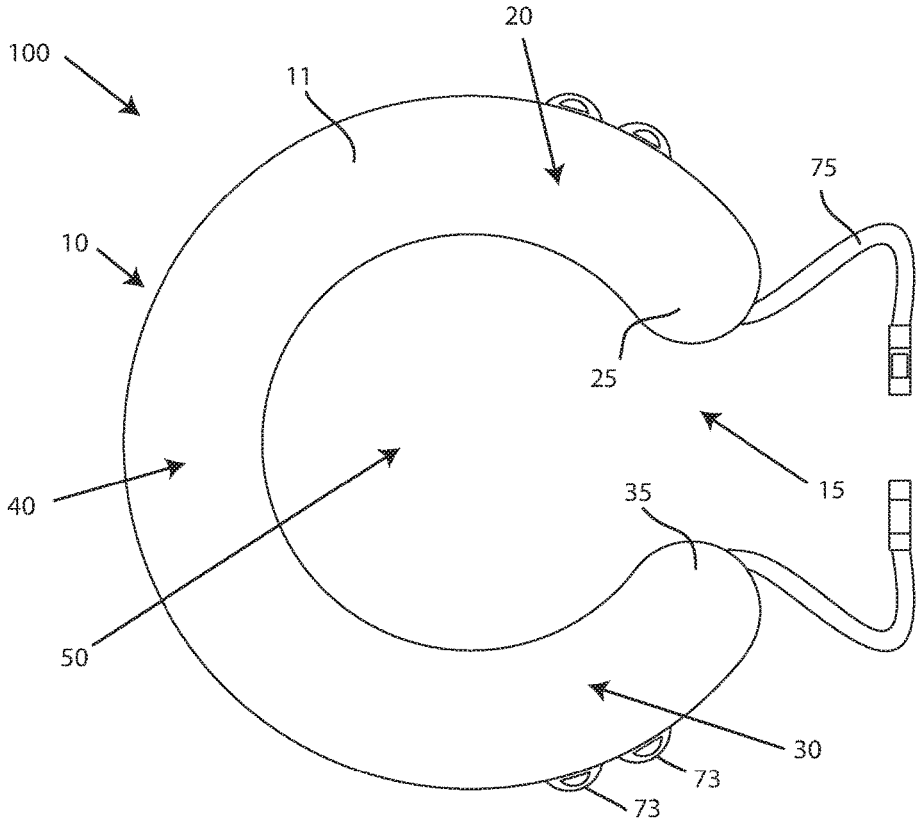
FIG. 3 depicts a top view of an embodiment of the nursing pillow.

Referring to the drawings, FIGS. 1-3 depict embodiments of a nursing pillow 100. Embodiments of nursing pillow 100 may be a pillow, a pillow device, a cushion, a cushioned device, and the like, configured to comfortably and safely accommodate an infant. Embodiments of the nursing pillow 100 may be a nursing pillow, a breastfeeding pillow, a nursing cushion, an infant feeding device, an infant support device, and the like. Embodiments of the nursing pillow 100 may be worn by a user, such as a mother during breastfeeding, or a father or other caretaker when feeding or otherwise caring for the infant. The nursing pillow 100 may also be worn when the infant is not feeding, to support the infant in a proper resting position. In an exemplary embodiment, the nursing pillow 100 may be worn around a torso of the user. The torso of the user may include a chest, an abdomen, a hip, a pelvis, or other general body portion of the user associated with the torso. In other embodiments, the nursing pillow 100 may be worn by the user around body portions other than torso, provided that the positioning of the nursing pillow 100 promote a proper resting or eating position for the infant.

Furthermore, embodiments of the nursing pillow 100 may include a continuous body structure 10, a first portion 20, a second portion 30, a middle portion 40, a receiving area 50, and a nursing surface 11.

Embodiments of the nursing pillow 100 may include a continuous body structure 10. Embodiments of the continuous body structure 10 may define a general shape and/or structure of the nursing pillow 100. Embodiments of the continuous body structure 10 of the nursing pillow 100 may include a top surface 11, a bottom surface 12, an outer side surface 13, and an inner side surface 14. The curved body structure 10 may be comprised of a foam material or other cushion material that is dense enough to comfortably support a body of an infant, but flexible and elastic enough to have a volume of the body structure 10 significantly reduced. For example, the continuous body structure 10 may be comprised of a memory foam material. Embodiments of the continuous body structure 10 may include a first portion 20 extending from a middle portion 40 to a first free end 25, and a second portion 30 extending from the middle portion 40 to a second free end 35. The first portion 20, the second portion 30, and the middle portion may be structurally integral so as to form a continuous body structure of the nursing pillow 100. For example, the first portion 20, the second portion 30, and the middle portion 40 may be portions of the same structural member. The surfaces 11, 12, 13, 14 of the continuous body structure 10 may continuously extend from the first free end 25 to the second free end 35.

Furthermore, embodiments of the continuous body structure may be curved or otherwise curvilinear. For example, the entire nursing pillow 100 may have an outer edge that is continuously curved or otherwise curvilinear. In one embodiment, the body structure 10 of the nursing pillow 100 may be "C" shaped. In another embodiment, the body structure 10 of the nursing pillow 100 may be "U" shaped. The continuous body structure 10 of the nursing pillow 100 may have various curved or curvilinear configurations, which may comfortably fit around a torso of the user. In an exemplary embodiment, the first portion 20, the second portion 30, and the middle portion may share the same general curvature to form a continuous body structure 10. In other embodiments, the curvature of the middle portion 40 may be slightly different than a general curvature of the first portion 20 and the second portion 30. In alternative embodiments, the continuous body structure 10 may have an outer edge that may be straight for at least a portion, having squared edges. For example, the continuous body structure 10 may be defined by two straight portions 20, 30, wherein the middle portion 40 is perpendicular or substantially perpendicular to the first portion 20 and the second portion 30.

Referring still to FIGS. 1-3, embodiments of the first portion 20 and the second portion 30 may be flexible to accommodate varying sizes of a user's torso, when being worn by the user. For example, the first portion 10 and the second portion 30 may deflect or otherwise move due to the first free end 25 being spaced apart from the second free end 35. An opening 15 may be present between the first free end 25 and the second free end 35, which allows a user to place the nursing pillow 100 around the user's torso. Embodiments of the first portion 20 may be a portion of the continuous body structure 10 that extends from the middle portion 40 to a first side of the user's torso. The first portion 20 may be an arm, a side arm, a member, a portion, a side portion, and the like. Similarly, the second portion 30 may be a portion of the continuous body structure 10 that extends from the middle portion 40 to a second, opposing side of the user's torso. The second portion 30 may be an arm, a member, a portion, a side portion, and the like, configured to act as an extension from the middle portion 40.

Embodiments of the nursing pillow 100 may include a receiving area 50. Embodiments of the receiving area 50 may be an opening, a receptacle, a space, a void, a region, and the like, sized and dimensioned to receive, accommodate, etc. a torso of user. For instance, the receiving area 50 may be filled or partially filled or occupied by the torso of the user when the nursing pillow 100 is being worn by the user. Embodiments of the receiving area 50 may be located between the first portion 20 and the second portion 30. Embodiments of the receiving area 50 may be configured to receive and/or accommodate the torso of the user, such that the first portion 20 may wrap partially around a first side of the torso of the user, and the second portion 30 may wrap partially around a second side of the torso of the user, and the middle section 40 may face a front side of the torso of the user. In an exemplary embodiment, the inner side surface 14 of the continuous body structure 10 may engage, snugly or otherwise, the torso of the user. The inner side surface 14 may engage the user's torso continuously or may have intermittent contact with the user's torso depending on a combination of the size of the receiving area 50 and the size of the user's torso. As described above, the first portion 20 and/or the second portion 30 may be capable of deflecting or otherwise flexing outwardly as the user places the nursing pillow 100 around the user's torso. As a result, the first and second portions 20, 30 may exert a biasing force or compression against the user's torso to effectuate a comfortable snug fit against the user's torso, which may prevent or hinder unwanted disengagement of the nursing pillow 100 from the user's torso. Further, embodiments of the receiving area 50 may vary in area depending on the size of the nursing pillow 100, in particular, a length, width, and/or curvature of the continuous body structure 10.

Moreover, embodiments of the nursing pillow 100 may include a nursing surface, wherein an infant may reside on the pillow 100 during feeding, breastfeeding, resting, etc. Embodiments of the nursing surface may be a surface, portion, location, or region of the continuous body structure 10 that the infant may be placed. In an exemplary embodiment, the top surface 11 of the continuous body structure 10 may define the nursing surface. The nursing surface may include the entire top surface 11 of the body structure 10. In use, the nursing surface may be a top surface 11 pertaining to, associated with, or proximate or otherwise near the first portion 20, the second portion 30, and/or the middle portion 40, which define the continuous body structure 10.

Figure 4:
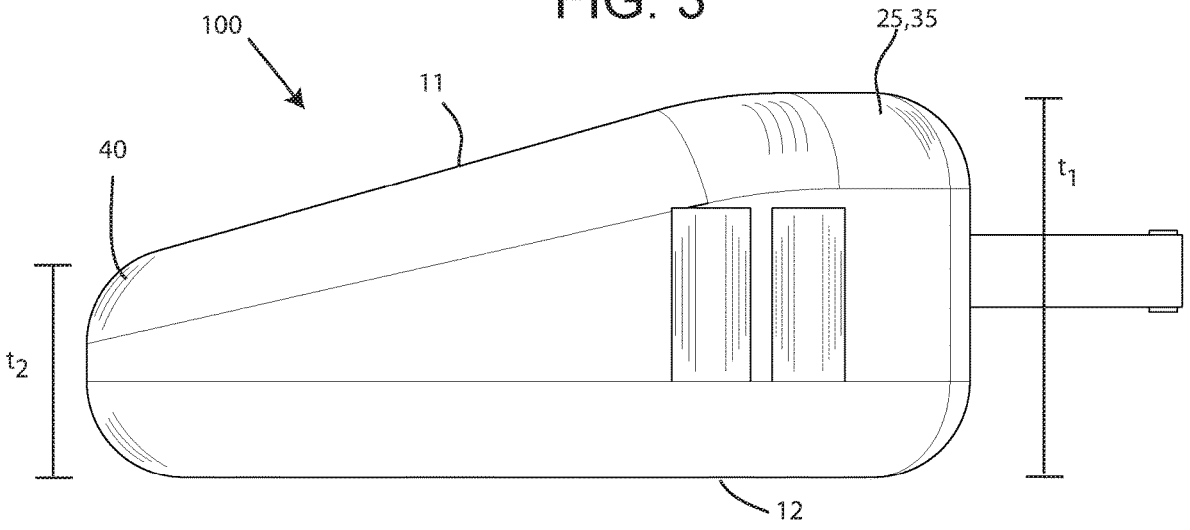
FIG. 4 depicts a side view of an embodiment of the nursing pillow.
Figure 5:
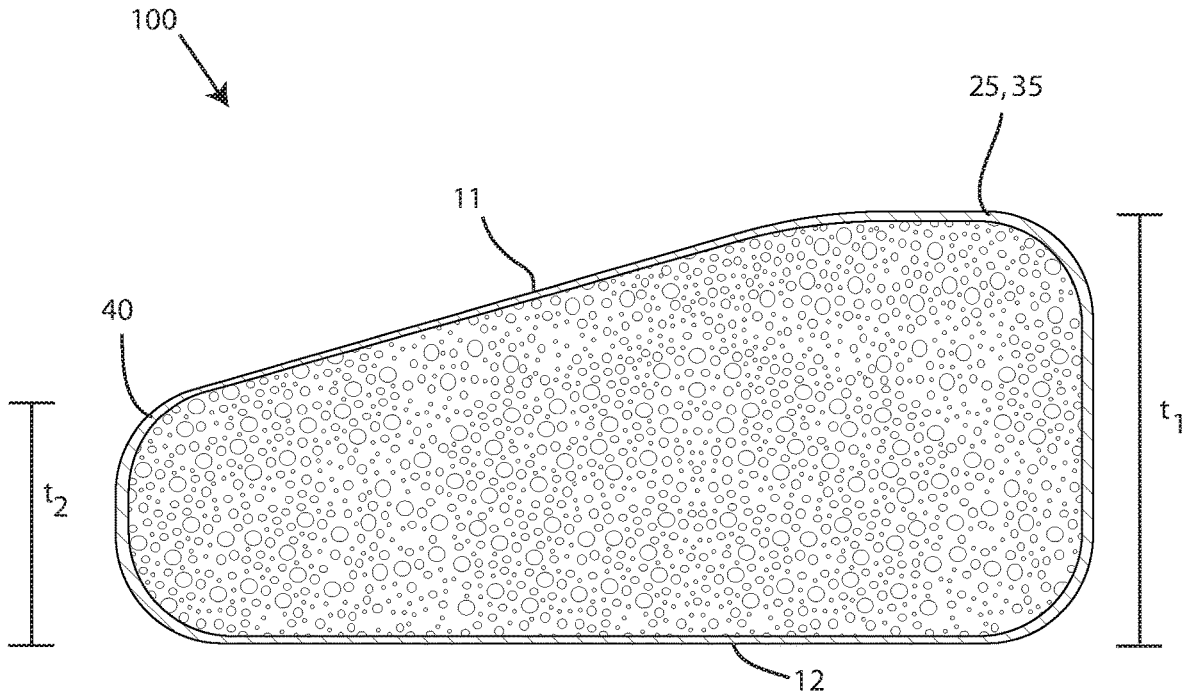
FIG. 5 depicts a cross-sectional view of an embodiment of the nursing pillow.
Figure 6:
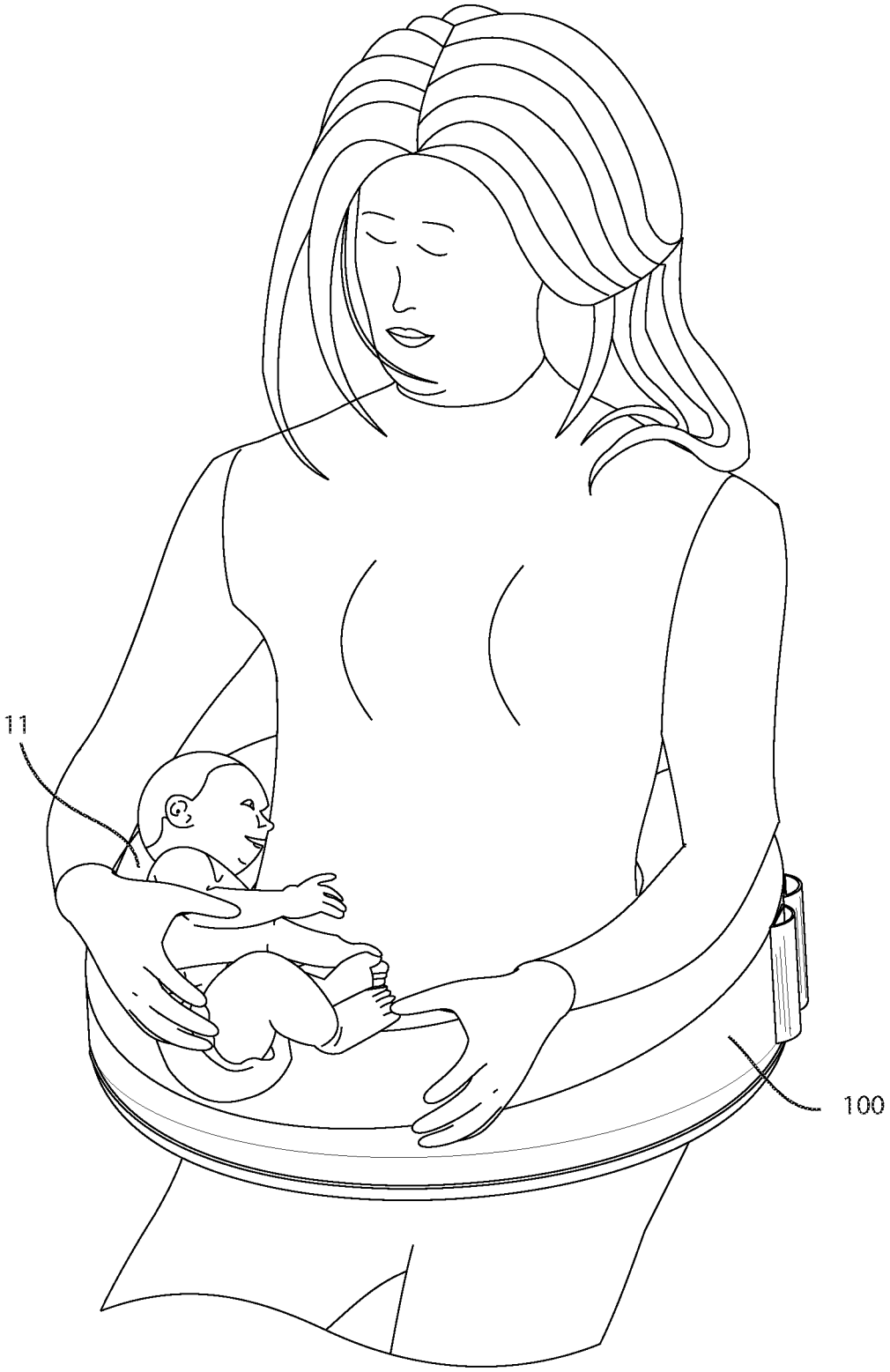
FIG. 6 depicts an embodiment of the nursing pillow being worn by a user.

With reference now to FIGS. 4 and 5, embodiments of the nursing pillow 100 may include a nursing surface that promotes a proper positioning of the infant when feeding, breastfeeding, resting, etc. For instance, the nursing surface 11 may be a ramped surface that slopes downwardly from a starting point at or near the free ends 25, 35 of the first and second portions 20, 30 and continues towards the middle portion 40 of the nursing pillow. The top surfaces of the first portion 20 and the second portion 30 may be coplanar, such that a thickness of the first portion 20 and a thickness of the second portion 30 may be equivalent or substantially equivalent. Embodiments of a coplanar first portion 20 and second portion 30 may result in an evenly sloped nursing surface 11. Because the first portion 20 and the second portion 30 are disposed on a left side and a right side, respectively, of a user, the nursing pillow 100 may include a nursing surface 11 on either side of the user, as shown in FIG. 6. This configuration may allow the nursing pillow 100 to be convenient for both right-handed and left-handed users, or users who prefer to have the infant on one side as opposed to the other side. In other words, embodiments of the nursing pillow 100 may be a dual-inclined nursing pillow, wherein both the left and right side portions (e.g. first portion 20 and second portion 30) have an inclined nursing surface 11 for properly positioning an infant during feeding or breastfeeding. The dual incline nursing surfaces provided by the first portion 20 and the second portion 30 may allow a user to conveniently adjust to the other side and/or relocate the infant to the other side of the pillow 100 without a need to remove or adjust the pillow 100, which can avoid a disruption to the feeding session.

Furthermore, a thickness of the continuous body structure 10 at the first free end 25 and the second free end 35 may be greater than a thickness of the continuous body structure 10 proximate the middle portion 40. FIGS. 4 and 5 depicts a first thickness, $t_1$, of the body structure 10 proximate the free ends 25, 35, and a second thickness, $t_2$, of the body structure 10 proximate the middle portion 40. The first thickness, $t_1$, and the second thickness, $t_2$, may also be referred to as a height of the body structure 10. The first thickness, $t_1$, may be significantly or even slightly greater than the second thickness, $t_2$, to effectuate an inclined nursing surface 11. In other words, embodiments of the nursing surface 11 may be an inclined surface (or declined surface from the perspective of the front of the torso of the user) due to a difference in thickness or height at the opposing ends of the nursing pillow 100. Moreover, embodiments of the nursing surface 11 of the pillow 100 may have a gradually reducing thickness in a direction away from the torso of the user, such that an infant, when residing on the nursing surface 11, can be prevented from being wedged in a gap between the continuous body structure and the torso of the user. For instance, a nursing surface that slopes downwardly towards the torso of the user may create gap or area between the torso of the user and the nursing surface, wherein an infant can be wedged during use of the pillow with such a configuration. Embodiments of the nursing surface 11, due to the angle of the nursing surface 11 sloping downwardly away from the torso of the user, may prevent the infant from being wedged. In some embodiments, the nursing surface 11 may be configured to slightly urge or prop the infant in a direction away from the torso.

Figure 7:
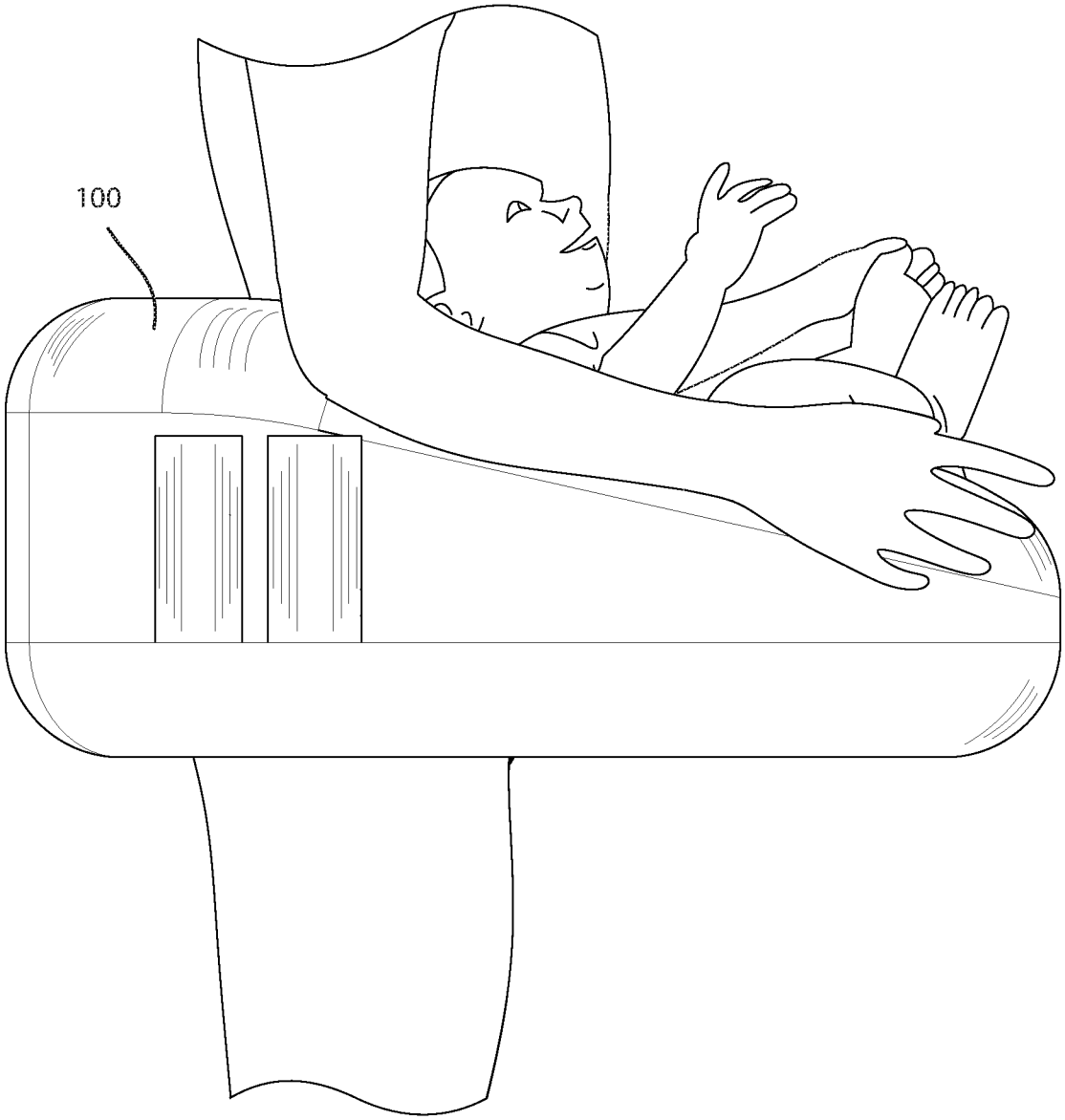
FIG. 7 depicts an embodiment of the nursing pillow, wherein an infant is residing on the nursing pillow.

Further, embodiments of the ramped nursing surface 11 may facilitate a head of the infant to be elevated with respect to the feet of the infant, as shown in FIGS. 6 and 7. For instance, the head of the infant may reside proximate the first free end 25 of the nursing pillow 100, and the feet of the infant may reside proximate the middle portion 40. As a result of the gradually reduced thickness or height from the first free end 25 of the first portion 20 to the middle portion, the infant's head may be elevated or higher than the feet of the infant. In one embodiment, when the infant is located on the nursing surface 11, the head of the infant may be closer to the torso of the user than a feet of the infant. Embodiments of the nursing pillow 100 may thus ensure that the infant may lay or rest in an inclined position, which promotes a proper swallowing position, wherein the infant's swallowing is not hampered and air intake is decreased.

Referring back to FIG. 1, embodiments of the nursing pillow 100 may include an adjustable strap 75. Embodiments of the adjustable strap 75 may be a belt, a strap, a clasp, a latch, a securing latch, a securing means, or other securing element. Embodiments of the adjustable strap 75 may allow for a user to releasably secure the pillow 100 to the user's torso, when being worn by the user. The adjustable strap 75 may be attached or affixed directly to the nursing pillow 100. Additionally, embodiments of the nursing pillow 100 may include one or more pockets 73. Embodiments of pockets 73 may be a pocket, a pouch, a holder, a loop, a sack, a compartment, and the like. Embodiments of the pocket 73 may be disposed on an outer side surface 13 of the continuous body structure 10. In an exemplary embodiment, a user may use the pockets 73 to hold or otherwise store various items, including lactation supplies or support needs, infant items, cloths, etc. Embodiments of the nursing pillow 100 may further include a semi-rigid layer 60 attached to a bottom surface 12 of the continuous body structure 10. The semi-rigid layer may be configured to operate as a lap desk base, constructed of a denser material than a material of the continuous body structure 10. For instance, the semi-rigid layer 60 may be overmolded to the bottom surface 12 of the pillow 100. Further embodiments of the nursing pillow 100 may also include a cover configured to cover the continuous body structure 10 and/or the nursing surface 11. Embodiments of the cover may be removable and washable. The cover may also include pockets 73 and the adjustable strap 75 attached thereto.

Figure 8:
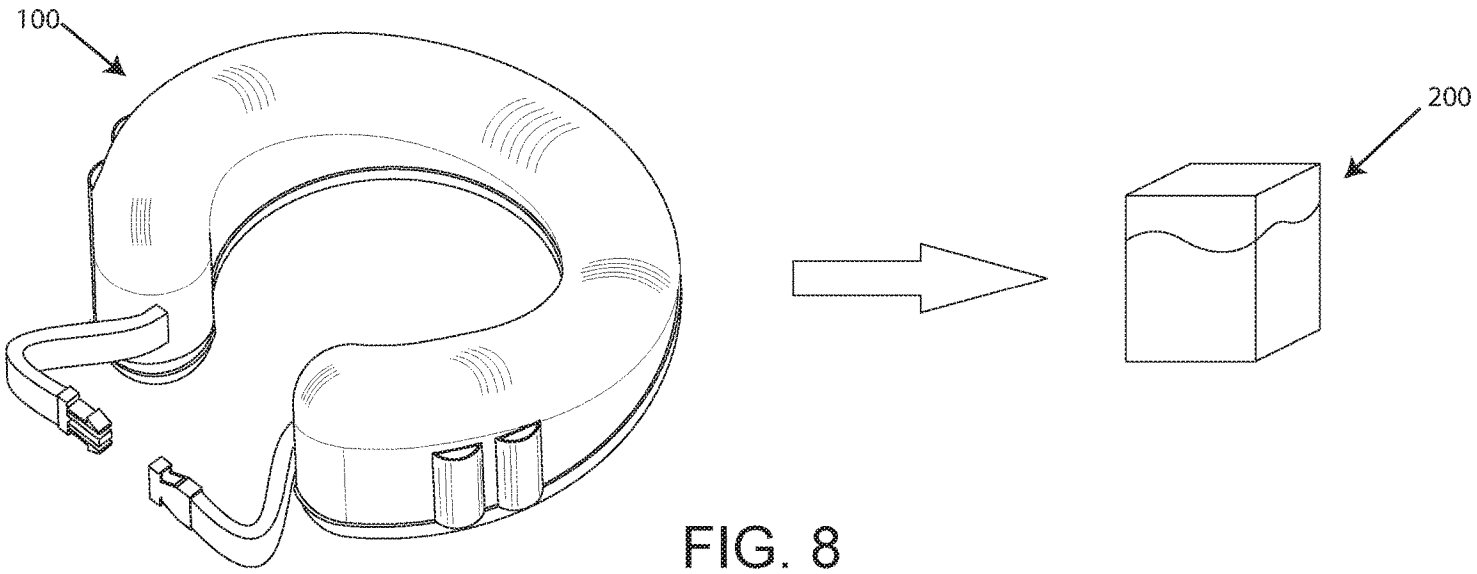
FIG. 8 depicts a schematic view of an embodiment of a nursing pillow that has been vacuum sealed into a vacuum sealed stackable unit.

With continued reference to the drawings, FIG. 8 depicts a schematic view of an embodiment of a nursing pillow that has been vacuum sealed into a vacuum sealed stackable unit 200 for facilitating an efficient display or stocking of the nursing pillows, including nursing pillow 100. Embodiments of the vacuum sealed stackable unit 200 may contain nursing pillow 100, but may also contain any type of nursing pillow. The vacuum sealed stackable unit 200 may include a packaging unit, such as clear or transparent material, plastic bag other suitable material to be used for retail packaging. Embodiments of the packaging may be shaped as a cube or similar structure, such that when the vacuum force is applied to the interior of the packaging unit with the nursing pillow, the resultant stackable unit 200 may have at least one flat surface for ease of stacking on a shelf on a salesfloor (e.g. a cubed unit, cuboid, rectangular cuboid, and the like). In an exemplary embodiment, the vacuum sealed stackable unit 200 may be an 8"×8" cube. In other embodiments, the stackable unit may be a rectangular cube. Further, the stackable unit 200 may include signage or similar advertising or product information labeling.

As an example, one or more nursing pillows may be placed within the packaging unit, and a vacuum or other suction force may draw the air out of the packaging to reduce a size of the packaging as well as reducing a size or volume of the nursing pillow within the packaging unit. The result may be a vacuum sealed stackable unit 200, which may contain one or more nursing pillows, including pillow 100. In an exemplary embodiment, the nursing pillow 100 is vacuum packed inside a stackable vacuum unit 200, allowing a size of the continuous body structure 10 to be significantly reduced to save shelf space on a salesfloor. The continuous body structure 10 may be of a memory foam or other foam or foam-like material, which facilitates the reduction in size of the continuous body structure 10 of the pillow 100.

Figure 9:
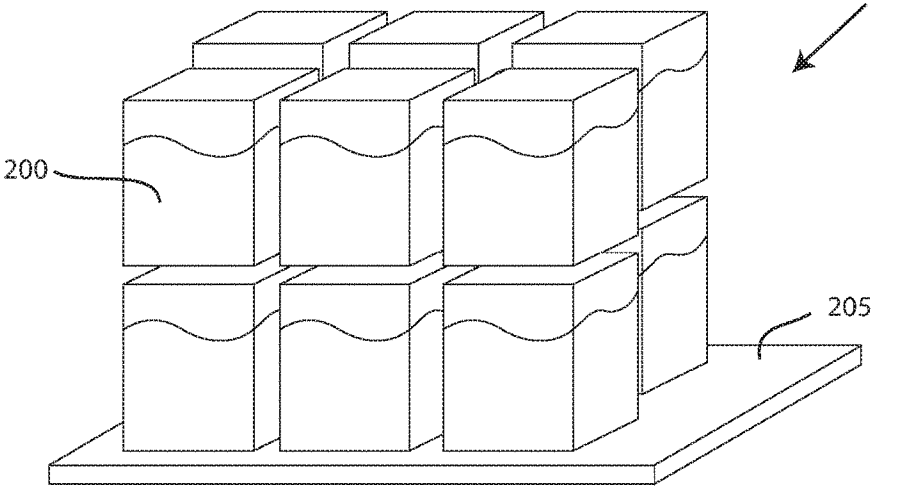
FIG. 9 depicts a schematic view of a plurality of vacuum sealed stackable units displayed on a shelf of a salesfloor.

FIG. 9 depicts a schematic view of a plurality of vacuum sealed stackable units displayed on a shelf of a salesfloor. By significantly reducing a size of a nursing pillow, precious shelf space is saved, allowing for significantly more nursing pillows to be stocked and/or displayed by a retailer. For instance, a method of displaying a plurality of nursing pillows on a salesfloor may include the steps of reducing a size of the plurality of nursing pillows by vacuum sealing each nursing pillow of the plurality of nursing pillows inside a stackable vacuum unit 200, and stacking the stackable vacuum unit 200 on a shelf 205 located on the salesfloor (or other retail or distribution location) to reduce a volume per nursing pillow on the shelf 205. Embodiments of the nursing pillow being vacuum sealed may include a ramped nursing surface, as described in association with nursing pillow 100. The shelf 205 on a salesfloor, a receiving area, or stock room of a retailer may include a plurality of stackable vacuum units 200 stacked on top of one another, depicted by 210 in FIG. 9. Accordingly, premium shelf space for infant products is used efficiently to display significantly more nursing pillows than previously allowed by non-vacuum sealed nursing pillows.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A nursing pillow comprising:

a continuous body structure, the continuous body structure including a first portion extending from a middle portion to a first free end, a second portion extending from the middle portion to a second free end, the first free end spaced apart from the second free end by an opening therebetween;

a receiving area located between the first portion and the second portion, the receiving area configured to receive a torso of a user, such that the first portion wraps partially around a first side of the torso of the user, the second portion wraps partially around a second side of the torso of the user, and the middle portion faces a front side of the torso of the user; and a ramped nursing surface defined by a top surface of the continuous body structure, the ramped nursing surface having a slope defined by a highest point at an inner edge of the continuous body structure proximate the torso of the user and a lowest point at an outer edge distal to the torso of the user, wherein the ramped nursing surface is configured to accommodate an infant;

wherein a thickness of the continuous body structure at the first free end and the second free end is greater than a thickness of the continuous body structure proximate the middle portion and gradually decreases towards the middle portion from the first free end and the second free end, respectively.

2. The nursing pillow of claim 1, wherein the continuous body structure is curved, and the first portion and the second portion are curved.

3. The nursing pillow of claim 1, wherein the nursing pillow is vacuum packed inside a stackable vacuum unit, allowing a size of the continuous body structure to be significantly reduced to save shelf space on a salesfloor.

4. The nursing pillow of claim 3, wherein the continuous body structure is made of a memory foam, which facilitates the reduction in size of the continuous body structure.

5. The nursing pillow of claim 1, wherein the ramped nursing surface facilitates a head of the infant to be elevated with respect to the feet of the infant.

6. The nursing pillow of claim 5, wherein, when the infant is located on the ramped nursing surface, the head of the infant is closer to the torso of the user than a feet of the infant.

7. The nursing pillow of claim 1, wherein a semi-rigid layer may be attached to a bottom surface of the continuous body structure, the semi-rigid layer being constructed of a denser material than a material of the continuous body structure.

8. The nursing pillow of claim 1, further comprising a washable cover configured to cover the continuous body structure.

9. The nursing pillow of claim 3, wherein the stackable vacuum unit containing the vacuum packed nursing pillow is stacked proximate additional stackable vacuum units.

10. The nursing pillow of claim 1, further comprising a releasably locking strap for securing the nursing pillow to the torso of the user, the reliably locking strap configured to span the opening between the first free end and the second free end.

11. The nursing pillow of claim 1, wherein the nursing pillow is worn by the user to breastfeed the infant.

12. The nursing pillow of claim 1, wherein the first portion and the second portion are coplanar.

13. A nursing pillow comprising:

a continuous body structure, the continuous body structure including a first portion having a thickness that increases as the first portion extends from a middle portion to a first free end, and a second portion having a thickness that increases as the second portion extends from the middle portion to a second free end, the first free end spaced apart from the second free end by an opening therebetween; and a receiving area located between the first portion and the second portion, the receiving area configured to receive a torso of a user, such that the first portion wraps partially around a first side of the torso of the user, the second portion wraps partially around a second side of the torso of the user, and the middle portion faces a front side of the torso of the user;

wherein the continuous body structure has a gradually reducing thickness starting from an inner edge of the continuous body structure proximate the torso of the user and ending at an outer edge distal to the torso of the user, wherein the gradually reducing thickness of the continuous body structure prevents the infant from being wedged in a gap between the continuous body structure and the torso of the user.

14. The nursing pillow of claim 13, wherein the continuous body structure is curved, and the first portion and the second portion are curved.

15. The nursing pillow of claim 13, wherein the nursing pillow is vacuum packed inside a stackable vacuum cube, allowing a size of the continuous body structure to be significantly reduced to save shelf space on a salesfloor.

16. The nursing pillow of claim 13, wherein a head of the infant is elevated above a feet of the infant when residing on the continuous body structure.

17. The nursing pillow of claim 1, wherein the continuous body structure is formed from a single piece of foam.

18. The nursing pillow of claim 13, wherein the continuous body structure is formed from a single piece of foam.

* * * * *